US007686660B2

(12) United States Patent
Chamuel

(10) Patent No.: US 7,686,660 B2
(45) Date of Patent: Mar. 30, 2010

(54) CONNECTOR AND RECEPTACLE THEREFOR

(75) Inventor: Steve R. Chamuel, Danvers, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 12/082,290

(22) Filed: Apr. 10, 2008

(65) Prior Publication Data

US 2009/0258535 A1 Oct. 15, 2009

(51) Int. Cl.
*H01R 13/64* (2006.01)

(52) U.S. Cl. ..... 439/680

(58) Field of Classification Search ..... 439/527, 439/660, 677, 680
See application file for complete search history.

(56) References Cited

U.S. PATENT DOCUMENTS

| | | | | | |
|---|---|---|---|---|---|
| 3,399,374 | A * | 8/1968 | Vito Pauza et al. | ..... | 439/355 |
| 4,053,199 | A * | 10/1977 | Hollyday et al. | ..... | 439/83 |
| 4,402,564 | A * | 9/1983 | Frantz | ..... | 439/350 |
| 4,518,209 | A * | 5/1985 | Negley | ..... | 439/92 |
| 4,960,387 | A * | 10/1990 | Davis et al. | ..... | 439/374 |
| 5,147,220 | A * | 9/1992 | Lybrand | ..... | 439/567 |
| 5,599,199 | A | 2/1997 | Wright | | |
| 5,601,446 | A | 2/1997 | Wright | | |
| 5,823,814 | A | 10/1998 | Alwine | | |
| 5,890,931 | A * | 4/1999 | Ittah et al. | ..... | 439/679 |
| 5,908,322 | A * | 6/1999 | Seki | ..... | 439/212 |
| 5,993,239 | A | 11/1999 | Wright | | |
| 6,022,239 | A | 2/2000 | Wright | | |
| 6,093,045 | A | 7/2000 | Hoff | | |
| 6,162,090 | A * | 12/2000 | Klubenspies et al. | ..... | 439/564 |
| 6,354,860 | B1 | 3/2002 | Miller et al. | | |
| 6,503,108 | B1 * | 1/2003 | Kikuchi et al. | ..... | 439/680 |
| 6,508,678 | B1 * | 1/2003 | Yang | ..... | 439/677 |
| 7,252,549 | B2 * | 8/2007 | Nishio et al. | ..... | 439/607 |
| 7,331,826 | B2 * | 2/2008 | Usui et al. | ..... | 439/680 |
| 7,491,094 | B2 * | 2/2009 | Usui et al. | ..... | 439/677 |
| 2007/0249222 | A1 * | 10/2007 | Skluzacek et al. | ..... | 439/541.5 |

* cited by examiner

*Primary Examiner*—Edwin A. Leon
*Assistant Examiner*—Larisa Tsukerman
(74) *Attorney, Agent, or Firm*—William H. McNeill; Shaun P. Montana

(57) ABSTRACT

An assembly (10) comprises a receptacle (12) having a base (14) including a single longitudinal row (16) of male connector pins (18) extending above and below the base. First wall and second walls (20, 22) project above the base (14) and have similar heights but differing widths, W and $W_1$. The first wall and the second wall are spaced differing distances D and $D_1$ from the single row of pins (18). A connector (24) with a central body (26) is formed to engage the receptacle (12) by mating with the uneven walls W and $W_1$ and the asymmetric spacing of the pins (18). The uneven walls and the asymmetrical spacing of the pins (18) from the walls provide plural asymmetries assuring a positive alignment for the pieces of the assembly (10).

2 Claims, 5 Drawing Sheets

CONNECTOR AND RECEPTACLE THEREFOR

TECHNICAL FIELD

This invention relates to assemblies comprised of receptacles and connectors and more particularly to such receptacles and connectors of small size with plural keys.

BACKGROUND ART

Receptacles and connectors come in varying sizes and, as the size decreases, it becomes increasingly difficult to increase connecting points while maintaining connectability and keying ability without using important real estate on the parts themselves.

DISCLOSURE OF INVENTION

It is, therefore, an object of the invention to obviate the disadvantages of the prior art.

It is another object of the invention to improve receptacle-connector combinations.

Yet another object of the invention is the enhancement of receptacles and connectors.

These objects are accomplished, in one aspect of the invention, by the provision of an assembly comprising: a receptacle having a base including a longitudinal row of male connector pins extending above and below the base; a first wall projecting above the base, the first wall having a given height and a given width and being spaced a given distance from the longitudinal row of male connector pins; a second wall projecting above the base and having a height substantially equal to the given height and a width different from the given width and being spaced from the longitudinal row of connector pins a distance different from the given distance; a connector having a central body formed to fit between the first and second walls, the central body including a longitudinal row of female connector pins formed to engage the male connector pins, the central body including two oppositely disposed recesses, a first of the recesses being formed to engage the first wall and a second of the recesses being formed to engage the second wall.

The plural asymmetries insure proper alignment and good contact of the electrical pins.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
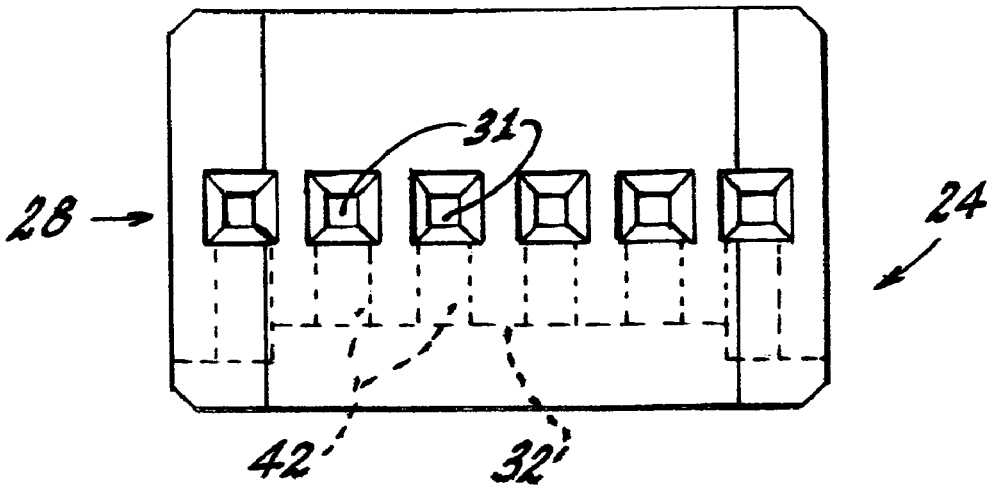
FIG. 1 is a plan view of a connector according to an aspect of the invention.
Figure 2:
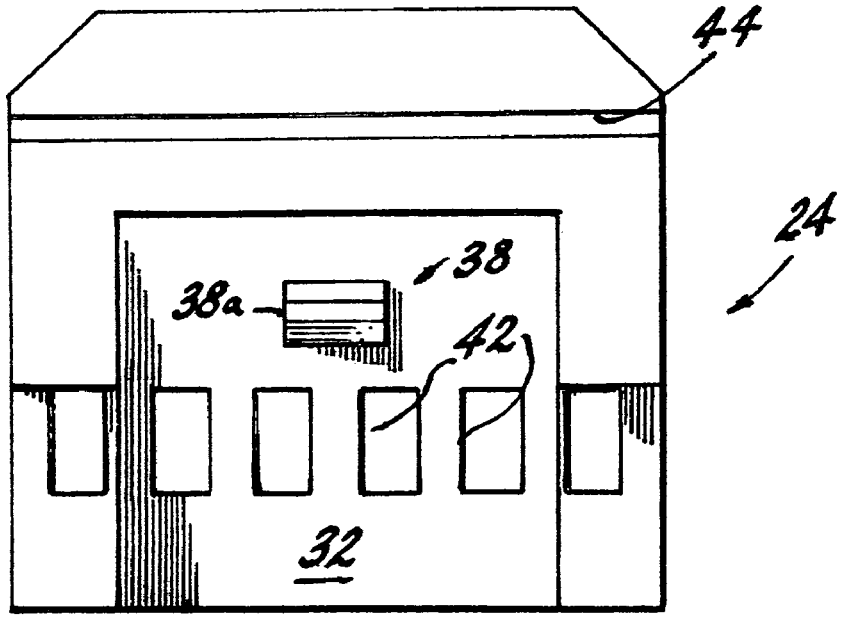
FIG. 2 is an elevation view thereof.
Figure 3:
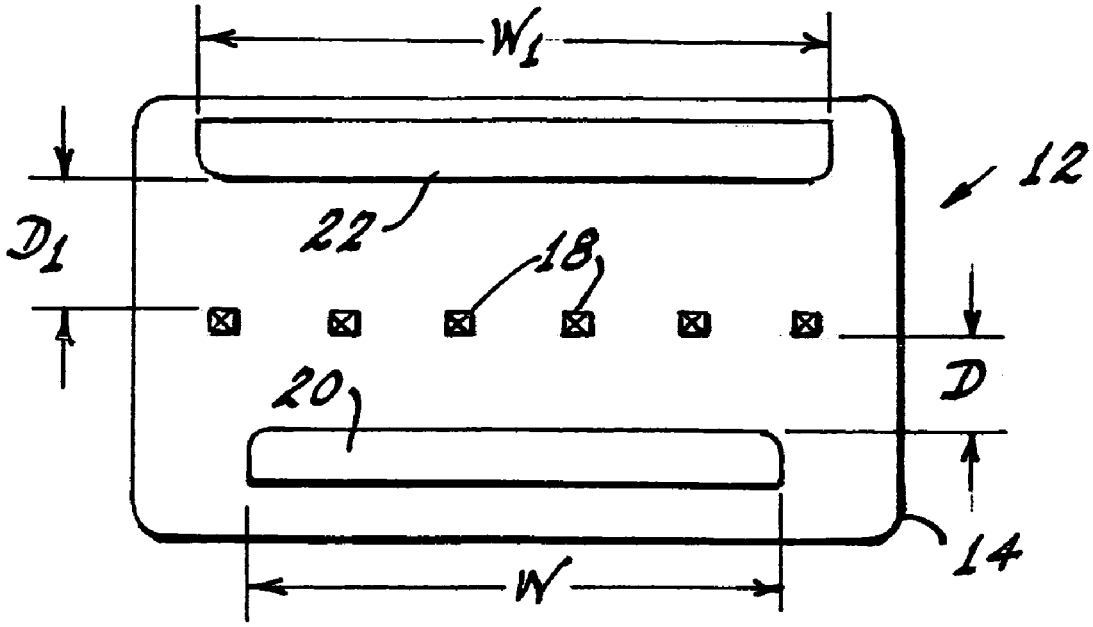
FIG. 3 is a plan view of a receptacle according to an aspect of the invention.
Figure 4:
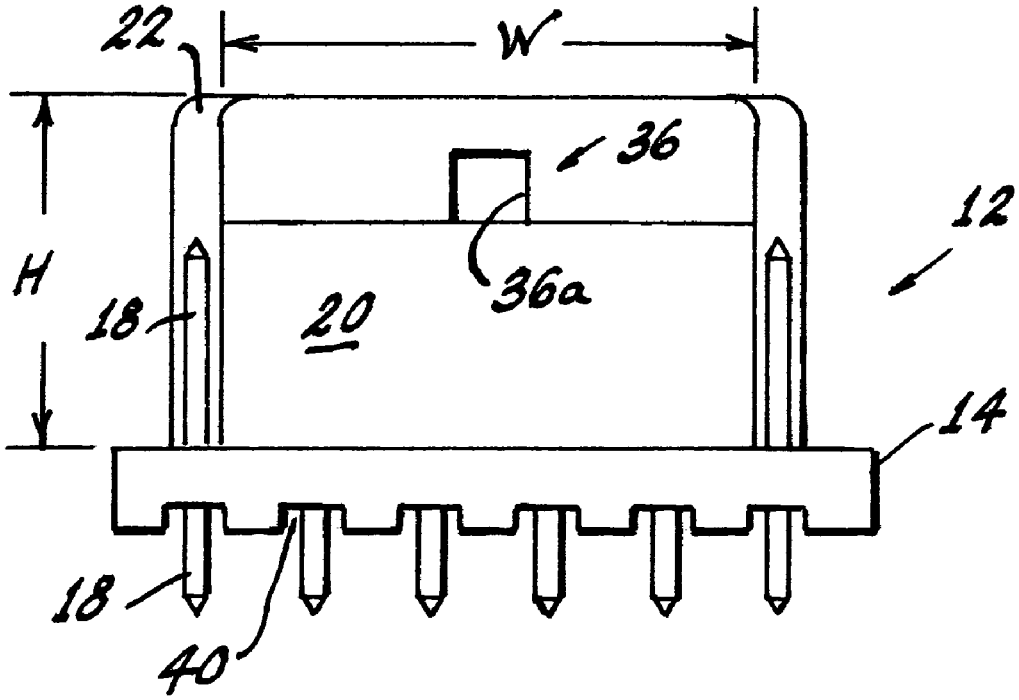
FIG. 4 is an elevation view thereof.
Figure 5:
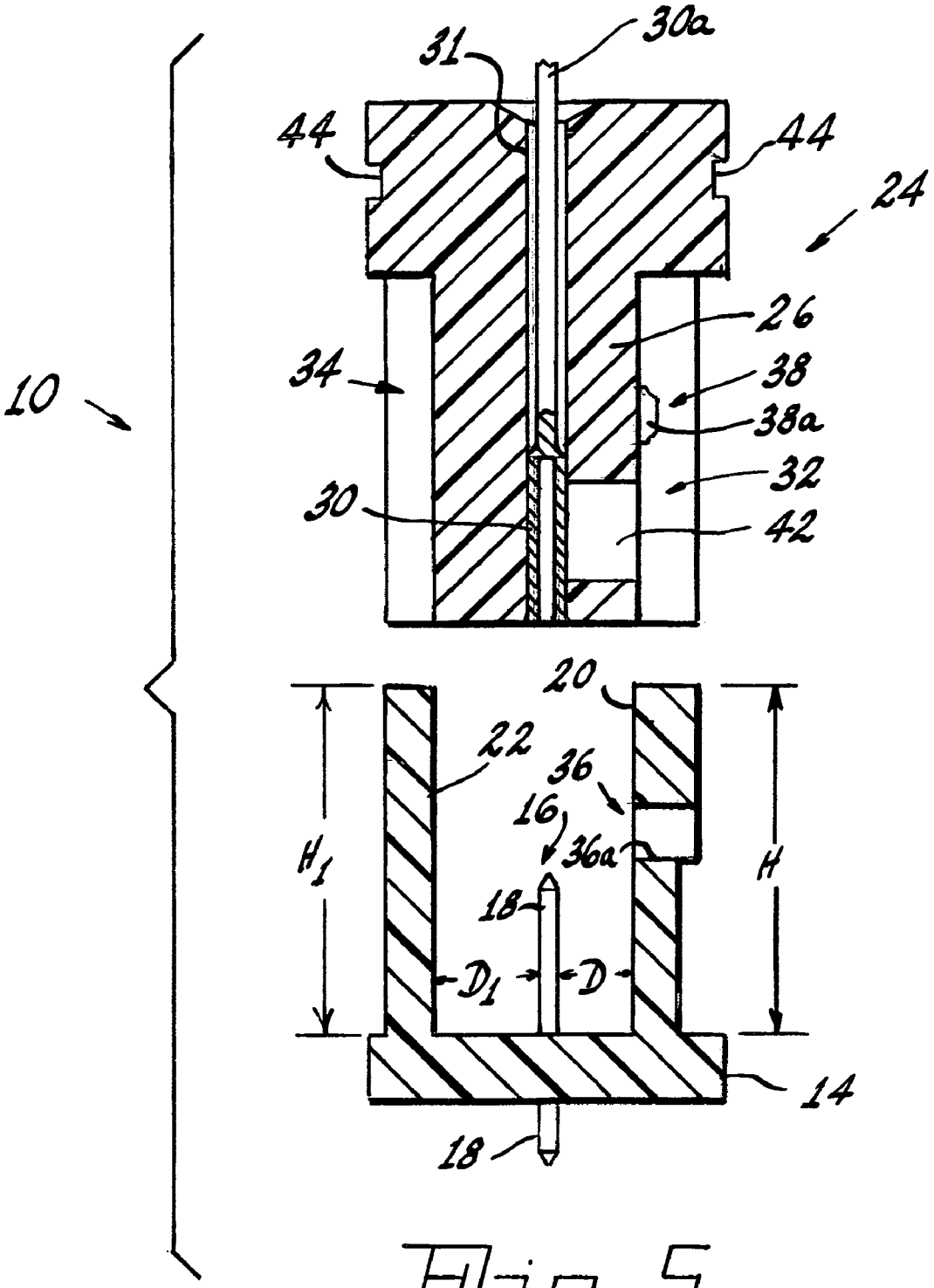
FIG. 5 is an exploded view of the receptacle-connector assembly.
Figure 6:
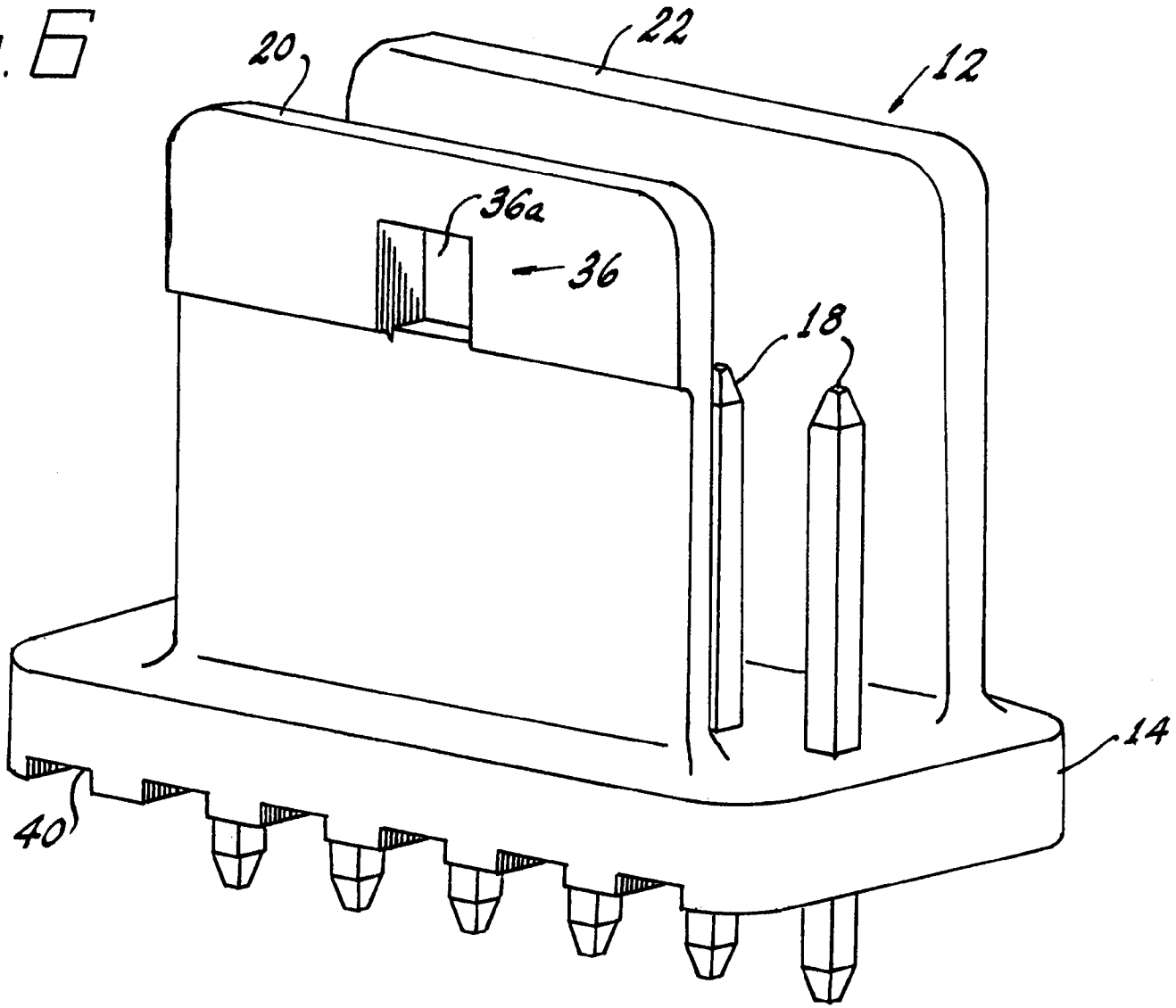
FIG. 6 is a perspective view of a receptacle according to an aspect of the invention.
Figure 7:
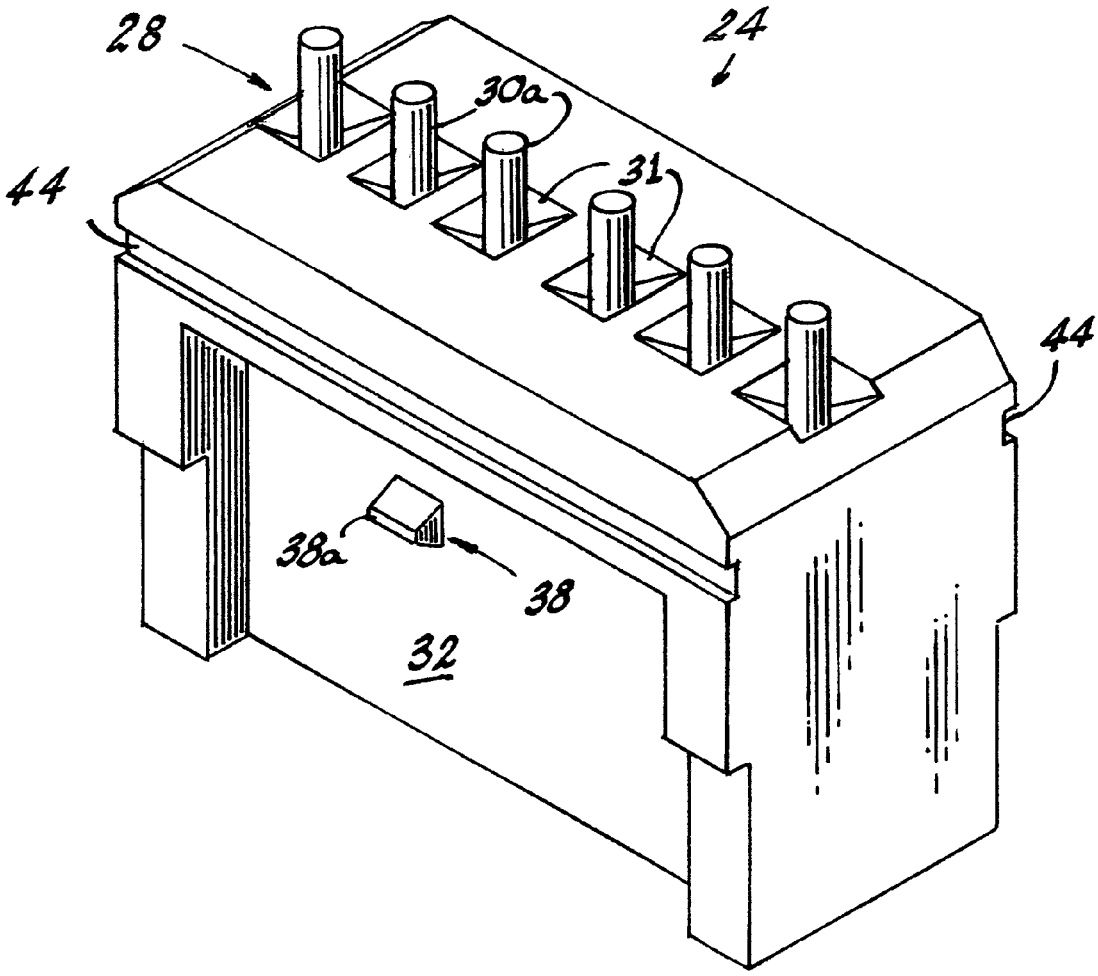
FIG. 7 is a perspective view of a connector according to an aspect of the invention, with some apertures omitted for clarity.

Referring now to the drawings with greater particularity, there is shown in FIG. 5 an assembly 10 comprising a receptacle 12 having a base 14 including a single longitudinal row 16 of male connector pins 18 extending above and below the base. A first wall 20 projects above the base 14, the first wall 20 having a given height H and a given width W and being spaced a given distance D from the longitudinal row 16 of male connector pins 18. A second wall 22 is spaced from the first wall 20 and also projects above the base 14. The second wall 22 has a height $H_1$ substantially equal to the given height H and a width $W_1$ different from the given width W and being spaced from the longitudinal row 16 of connector pins 18 a distance $D_1$ different from the given distance D. The varying widths of the walls 20 and 22 and the difference between D and $D_1$ is illustrated most clearly in FIG. 3

A connector 24 has a central body 26 formed to fit between the first and second walls 20, 22. The central body 26 includes a longitudinal row 28 of female connector pins 30 that are fitted into openings 31 that are formed in the body 26. The female connector pins 30 are formed to engage the male connector pins 18. The pins 30 can terminate at an opposite end in male ends 30*a* if desired. The central body 26 includes two oppositely disposed recesses 32, 34. A first of the recesses 32 is formed to engage the first wall 20 and a second of the recesses 34 is formed to engage the second wall 22. Accurate positioning of the connector with the receptacle is insured by the plural asymmetries developed by the varying distances D and $D_1$ and the varying widths W and $W_1$ of the first and second walls 20, 22, which cooperate with the recesses 32, 34. If desired, lateral apertures 42 can be provided for accessing the female connector pins 30 and the upper portion 26*a* of the central body 26 can be provided with slots 44 for receiving shields or other components.

To insure positive retention of the parts, the assembly 10 is provided with a latching feature. To achieve latching, one of the walls, for example, first wall 20, is provided with a latch receiver 36 in the form of an aperture 36*a* and one of the recesses, for example, recess 32, is provided with a latch 38, which can be in the form of a projection 38*a*.

Solder relieves 40 can be provided where necessary. In a preferred embodiment a high temperature dielectric material such as Grivory HT2VZ-15H or equivalent can be used. This material works well with assemblies of the sizes contemplated herein, that is, where the receptacle has dimensions of about 17×9.65 mm and a wall height of 9.58 mm.

Thus, while there have been shown and described what are at present considered to be the preferred embodiments of the invention, it will be apparent to those skilled in the art that various changes and modifications can be made herein without departing from the scope of the invention as defined by the appended claims.

What is claimed is:

1. An assembly comprising:

a receptacle having:

a base including only a single longitudinal row of rigid male connector pins extending above and below said base;

a first wall projecting above said base, said first wall having a given height and a given width and being spaced a given distance from said single longitudinal row of rigid male connector pins;

a second wall projecting above said base and having a height substantially equal to said given height and a width different from said given width and being spaced from said single longitudinal row of rigid male connector pins a distance different from said given distance; and a connector having:

a central body formed to fit between said first and second walls, said central body including a longitudinal row of female connector pins formed to engage said rigid male connector pins, said central body including two oppositely disposed recesses, a first of said recesses being formed to engage said first wall and a second of said recesses being formed to engage said second wall.

2. The assembly of claim 1 wherein one of said first or second walls includes a latch receiver and a counterpart recess includes a mating latch.

* * * * *